US012623832B2

(12) United States Patent
Hewitt

(10) Patent No.: US 12,623,832 B2
(45) Date of Patent: May 12, 2026

(54) PACKAGING MATERIAL FOR A SHIRT

(71) Applicant: Mainetti (UK) Ltd, Jedburgh (GB)

(72) Inventor: Ashley Hewitt, Jedburgh (GB)

(73) Assignee: Mainetti (UK) Ltd (GB)

( * ) Notice: Subject to any disclaimer, the term of this patent is extended or adjusted under 35 U.S.C. 154(b) by 465 days.

(21) Appl. No.: 17/798,500

(22) PCT Filed: Dec. 14, 2020

(86) PCT No.: PCT/GB2020/053203
§ 371 (c)(1),
(2) Date: Aug. 9, 2022

(87) PCT Pub. No.: WO2021/116716
PCT Pub. Date: Jun. 17, 2021

(65) Prior Publication Data

US 2023/0331462 A1 Oct. 19, 2023

(30) Foreign Application Priority Data

Dec. 13, 2019 (GB) ..... 1918411

(51) Int. Cl.
*B65D 85/18* (2006.01)

(52) U.S. Cl.
CPC ..... *B65D 85/182* (2013.01)

(58) Field of Classification Search
CPC ..... B65D 33/14; B65D 85/182; A47G 25/32; A47G 25/38; A45C 3/004
USPC ..... 206/292
See application file for complete search history.

(56) References Cited

U.S. PATENT DOCUMENTS

| | | | | | |
|---|---|---|---|---|---|
| 2,243,230 | A | | 5/1941 | Vandermade | |
| 2,560,684 | A | | 7/1951 | Caesar | |
| 2,560,710 | A | | 7/1951 | Akers | |
| 2,615,601 | A | * | 10/1952 | Kahn | B65D 85/182 206/297 |
| 2,665,051 | A | | 1/1954 | Tomarin | |
| 2,814,425 | A | | 11/1957 | Rutt | |
| 2,870,945 | A | | 1/1959 | Steele | |

FOREIGN PATENT DOCUMENTS

| | | | | | |
|---|---|---|---|---|---|
| CN | 202558065 | U | | 11/2012 | |
| DE | 1925115 | A1 | * | 11/1970 | B65B 25/20 |
| DE | 2103115 | A1 | | 8/1971 | |
| DE | 2611406 | A1 | | 9/1977 | |
| EP | 0042883 | A1 | | 1/1982 | |
| GB | 730780 | A | | 6/1955 | |
| GB | 904809 | A | | 8/1962 | |
| GB | 1341561 | A | * | 12/1973 | |
| GB | 2203033 | A | * | 10/1988 | A47G 25/1407 |
| GB | 2526293 | A | * | 11/2015 | A41B 3/18 |
| JP | 2005126129 | A | | 5/2005 | |

* cited by examiner

*Primary Examiner* — Anthony D Stashick
*Assistant Examiner* — Lauren Kmet
(74) *Attorney, Agent, or Firm* — The Belles Group, P.C.

(57) ABSTRACT

Packaging material for displaying a shirt is disclosed. The main purpose of the invention is to remove the use of plastics from the packing by more firmly holding the shirt using the cardboard shirt support. This is achieved using flaps and slots formed in the support cardboard, by using an easily removable plastic hook and by improving the collar support. A substantially plastic free twin pack for shirts is also disclosed.

16 Claims, 7 Drawing Sheets

PACKAGING MATERIAL FOR A SHIRT

CROSS-REFERENCE TO RELATED PATENT APPLICATIONS

The present application is a U.S. national stage application under 35 U.S.C. § 371 of PCT Application No. PCT/GB2020/053203, filed Dec. 14, 2020, which claims priority to United Kingdom Application No. 1918411.8, filed Dec. 13, 2019. The disclosures of the aforementioned priority applications are incorporated herein by reference in their entireties.

The present invention relates to packaging material for a shirt and relates particularly, but not exclusively, to plastic-free packaging used by retailers to display collared shirts for sale.

It has long been the practice for retailers to display shirts, and particularly collared front button up shirts, in a folded form supported on a cardboard mount. For many years this has increasingly involved the use of various plastics articles to assist in maintaining the shirt securely in position. These include various forms of plastic clips which are used to fix portions of the shirt to each other or to the cardboard mounting. Previously this function was achieved using metal pins. However, these have in recent years fallen out of favour due to the risk of pricking injuries. It is also very common for the shirt, once mounted on the cardboard, to be placed inside a transparent plastic bag. This both helps to hold the shirt in the required position and protects it when being transported and when on display.

Unfortunately, it is generally the case that the vast majority of these transparent plastic bags and the small plastic clips do not get recycled. The transparent bags are commonly made from polypropylene and low density polyethylene and although these material can be recycled it is not consistently available as an option in household recycling and even where it is householders often do not recycle such plastic bags. Similarly, the size of the plastic clips makes them difficult to recycle and they are more often disposed of to landfill in household waste. Although in principle these packaging materials can be recycled it is more desirable to replace them with non-plastic articles of more easily and more commonly recycled materials.

Preferred embodiments of the present invention seek to overcome or alleviate the above described disadvantages of the prior art.

According to a first aspect of the present invention there is provided a collar support used in packaging material for a shirt, the collar support comprising a first strip of cardboard material, wherein, in use, opposing ends of said first strip can be curved back towards each other to support the collar of a shirt and a tab connected to said first strip, wherein said tab comprises a button engager in the form of a cutaway portion in said strip.

In a preferred embodiment the cutaway portion is an aperture.

In another preferred embodiment the aperture is substantially cross shaped.

In a further preferred embodiment the cutaway portion is a notch extending from an edge of said tab.

According to a second aspect of the present invention there is provided a packaging material for a pair of shirts, the packaging material comprising:

- a first sheet of cardboard having a substantially rectangular body for engaging a first shirt;
- a first collar support comprising a second strip of cardboard material, wherein, in use, opposing ends of said second strip can be curved back towards each other to support the collar of said first shirt; and
- a second collar support as set out above for supporting the collar of a second shirt.

The packaging material may further comprise a second sheet of cardboard having a substantially rectangular body for engaging said second shirt.

In a preferred embodiment at least one of said first and second sheets comprises a substantially rectangular body with four edges including a top edge which, when the packaging material is in use, is located adjacent a respective collar of the shirt mounted to the packaging material and left and right edges connected to, and located to the left and right of, the top edge, wherein said sheet further comprises first and second flaps connected to said left and right edges of said body such that folding of said first and second flaps at least partially covers said body In another preferred embodiment the first shirt sheet comprises said first collar support.

In a further preferred embodiment the second shirt sheet comprises said second collar support.

The packaging material may further comprise a hook for suspending the packaging material and shirt from a rail and for joining said first sheet and said first collar support.

In a preferred embodiment the hook comprises a substantially planar hook body having a hook slot formed therein and at least one retaining projection extending from said hook body and said collar support comprises at least one tab for extending through said hook slot and at least one respective retaining aperture for receiving said retaining projection.

In another preferred embodiment the body of said sheet comprises a locking mechanism for locking said sheet onto said hook.

In a further preferred embodiment the locking mechanism comprises at least one locking aperture having a wider aperture portion and a narrower aperture portion and said retaining projection comprises a wider projection portion sized to pass through said wider aperture portion and narrower projection portion sized to prevent said wider projection portion from passing through and sized to allow said narrower projection portion to pass into said narrower aperture portion.

In a still further preferred embodiment the locking mechanism further comprises a locking projection mounted on a flexible arm and adapted to engage a further locking aperture such that when said locking projection is located in said further locking aperture movement of said body relative to the hook in the plain of said body is prevented.

According to a third aspect of the present invention there is provided a packaging material for a shirt, the packaging material comprising:

- a sheet of cardboard having a substantially rectangular body with four edges including a top edge which, when the packaging material is in use, is located adjacent a collar of the shirt mounted to the packaging material, wherein said body has a slot therein, said slot located adjacent to said top edge;
- a collar support, including a strip of cardboard material, wherein, in use, opposing ends of said strip can be curved back towards each other to support the collar of a shirt and said body and said collar support are formed separately; and
- a hook for suspending the packaging material and shirt from a rail and for joining said body and collar support.

In a preferred embodiment the sheet further comprises first and second flaps connected to said left and right edges of said body which are connected to, and located to the left and right of, the top edge such that folding of said first and second flaps at least partially covers said body.

In another preferred embodiment the collar support forms a loop and said ends are linked to one another by engaging slots formed in opposing long edges of said collar support, said slots being at least partially perforated.

In a further preferred embodiment the hook comprises a substantially planar hook body having a hook slot formed therein and at least one retaining projection extending from said hook body and said collar support comprises at least one tab for extending through said hook slot and at least one respective retaining aperture for receiving said retaining projection.

In a preferred embodiment the body of said sheet comprises a locking mechanism for locking said sheet onto said hook.

In another preferred embodiment the locking mechanism comprises at least one locking aperture having a wider aperture portion and a narrower aperture portion and said retaining projection comprises a wider projection portion sized to pass through said wider aperture portion and narrower projection portion sized to prevent said wider projection portion from passing through and sized to allow said narrower projection portion to pass into said narrower aperture portion.

In a further preferred embodiment the locking mechanism further comprises a locking projection mounted on a flexible arm and adapted to engage a further locking aperture such that when said locking projection is located in said further locking aperture movement of said body relative to the hook in the plain of said body is prevented.

According to a fourth aspect of the present invention there is provided a packaging material for a shirt, the packaging material comprising:

a sheet of cardboard having a substantially rectangular body with four edges including a top edge which, when the packaging material is in use, is located adjacent a collar of the shirt mounted to the packaging material and left and right edges connected to, and located to the left and right of, the top edge, wherein said sheet further comprises first and second flaps connected to said left and right edges of said body such that folding of said first and second flaps at least partially covers said body;

a collar support, including a strip of cardboard material, wherein, in use, opposing ends of said strip can be curved back towards each other to support the collar of a shirt and said body and said collar support are formed separately; and a hook for suspending the packaging material and shirt from a rail and for joining said body and collar support.

In a preferred embodiment the collar support forms a loop and said ends are linked to one another by engaging slots formed in opposing long edges of said collar support, said slots being at least partially perforated.

In another preferred embodiment the hook comprises a substantially planar hook body having a hook slot formed therein and at least one retaining projection extending from said hook body and said collar support comprises at least one tab for extending through said hook slot and at least one respective retaining aperture for receiving said retaining projection.

In a further preferred embodiment the body of said sheet comprises a locking mechanism for locking said sheet onto said hook.

In a preferred embodiment the locking mechanism comprises at least one locking aperture having a wider aperture portion and a narrower aperture portion and said retaining projection comprises a wider projection portion sized to pass through said wider aperture portion and narrower projection portion sized to prevent said wider projection portion from passing through and sized to allow said narrower projection portion to pass into said narrower aperture portion.

In another preferred embodiment the locking mechanism further comprises a locking projection mounted on a flexible arm and adapted to engage a further locking aperture such that when said locking projection is located in said further locking aperture movement of said body relative to the hook in the plain of said body is prevented.

According to a fifth aspect of the present invention there is provided a packaging material for a shirt, the packaging material comprising a sheet of cardboard having a substantially rectangular body with four edges including a top edge which, when the packaging material is in use, is located adjacent a collar of the shirt mounted to the packaging material and left and right edges connected to, and located to the left and right of, the top edge, wherein said body has a slot therein, said slot located adjacent to said top edge and wherein said sheet further comprises first and second flaps connected to said left and right edges of said body such that folding of said first and second flaps at least partially covers said body.

The packaging material may further comprise a collar support, including a strip of cardboard material opposing ends of which can be curved back towards each other to form a loop and said ends are linked to one another by engaging slots formed in opposing long edges of said collar support, said slots being at least partially perforated.

According to a sixth aspect of the present invention there is provided a packaging material for a shirt, the packaging material comprising:

a sheet of cardboard having a substantially rectangular body with four edges including a top edge which, when the packaging material is in use, is located adjacent a collar of the shirt mounted to the packaging material and left and right edges connected to, and located to the left and right of, the top edge, wherein said sheet further comprises first and second flaps connected to said left and right edges of said body such that folding of said first and second flaps at least partially covers said body; and a collar support, including a strip of cardboard material opposing ends of which can be curved back towards each other to form a loop and said ends are linked to one another by engaging slots formed in opposing long edges of said collar support, said slots being at least partially perforated.

According to a seventh aspect of the present invention there is provided a packaging material for a shirt, the packaging material comprising:

a sheet of cardboard having a substantially rectangular body with four edges including a top edge which, when the packaging material is in use, is located adjacent a collar of the shirt mounted to the packaging material and left and right edges connected to, and located to the left and right of, the top edge, wherein said body has a slot therein, said slot located adjacent to said top edge; and a collar support, including a strip of cardboard material opposing ends of which can be curved back towards each other to form a loop and said ends are linked to one another by engaging slots formed in opposing long edges of said collar support, said slots being at least partially perforated.

According to an eighth aspect of the present invention there is provided a packaging material for a shirt, the packaging material comprising:

a sheet of cardboard having a substantially rectangular body;

a collar support, including a strip of cardboard material, wherein, in use, opposing ends of said strip can be curved back towards each other to form a loop and said ends are linked to one another by engaging slots formed in opposing long edges of said collar support, said slots being at least partially perforated and said body and said collar support are formed separately; and a hook for suspending the packaging material and shirt from a rail and for joining said body and collar support.

In a preferred embodiment the hook comprises a substantially planar hook body having a hook slot formed therein and at least one retaining projection extending from said hook body and said collar support comprises at least one tab for extending through said hook slot and at least one respective retaining aperture for receiving said retaining projection.

In another preferred embodiment the body of said sheet comprises a locking mechanism for locking said sheet onto said hook.

In a further preferred embodiment the locking mechanism comprises at least one locking aperture having a wider aperture portion and a narrower aperture portion and said retaining projection comprises a wider projection portion sized to pass through said wider aperture portion and narrower projection portion sized to prevent said wider projection portion from passing through and sized to allow said narrower projection portion to pass into said narrower aperture portion.

In a still further preferred embodiment the locking mechanism further comprises a locking projection mounted on a flexible arm and adapted to engage a further locking aperture such that when said locking projection is located in said further locking aperture movement of said body relative to the hook in the plain of said body is prevented.

According to a ninth aspect of the present invention there is provided a collar support used in packaging material for a shirt, the collar support comprising a strip of cardboard material, wherein, in use, opposing ends of said strip can be curved back towards each other to form a loop and said ends are linked to one another by engaging slots formed in opposing long edges of said collar support, said slots being at least partially perforated and said body and said collar support are formed separately.

According to a tenth aspect of the present invention there is provided a packaging material for a shirt, the packaging material comprising:

a sheet of cardboard having a substantially rectangular body; and a collar support as set out above.

The above packaging materials all operate to reduce and/or eliminate the use of plastic materials in the packaging and display of shirts. The shirt remains displayed in its traditional form mounted on card. However, this is achieved in such a way as to use friction to hold portions of the shirt in engagement with each other so that the shirt can remain securely folded and mounted to the cardboard without the use of plastic clips, pins or containing the shirt within a plastic bag.

By providing a hook that joins the collar and body support portions, and in particular one that is planar with a slot formed therein, the advantage is provided that the a bag free shirt packaging can be provided which uses very little plastic and for which the plastic used (the hook) can be easily removed by the retailer when the article is sold. This allow easy reuse and recycling of the small plastic component by the retailer through well-established working practices with the packaging supplier as well whilst the cardboard can be recycled by the purchaser in their household recycling.

By providing a collar support for a shirt packaging material which includes a tab and a cutaway the advantage is provided the shirt which this support is being used on can be packaged in conjunction with a second shirt in a plastic free twin shirt retail package. Attaching the second shirt to a button of the first shirt ensures that the position of the second shirt, and in particular the collar thereof, are very precisely maintained thereby ensuring the best aesthetic display for the combined shirts. The absence of an outer plastic bag could make the shirts more vulnerable to separation or to the movement of one shirt relative to the other. The use of a collar support, as set out above, helps to ensure that such separation does not occur and that both shirts remain correctly presented.

By having the cuts in the collar support which are to be linked together perforated, the advantage is provided that only the two slots which are to be used need to have their perforations broken to form the slot. As a result, the remainder of the slots, particularly those that are closer to the centre of the collar support than the two slots which are used, maintain their structural integrity from the unbroken perforations. As a result, the card needed to support the collar can be thinner than that previously used thereby reducing the overall quantity of cardboard used. The support can a large range of collar sizes from very small to very large and significantly reduces the number of support components required in the prior art which typically included 3 or 4 plastic and cardboard parts. Furthermore, the card protrudes from the front of the collar making it is easier to remove.

Preferred embodiments of the present invention will now be described, by way of example only, and not in any limitative sense with reference to the accompanying drawings in which:—

Figure 6:
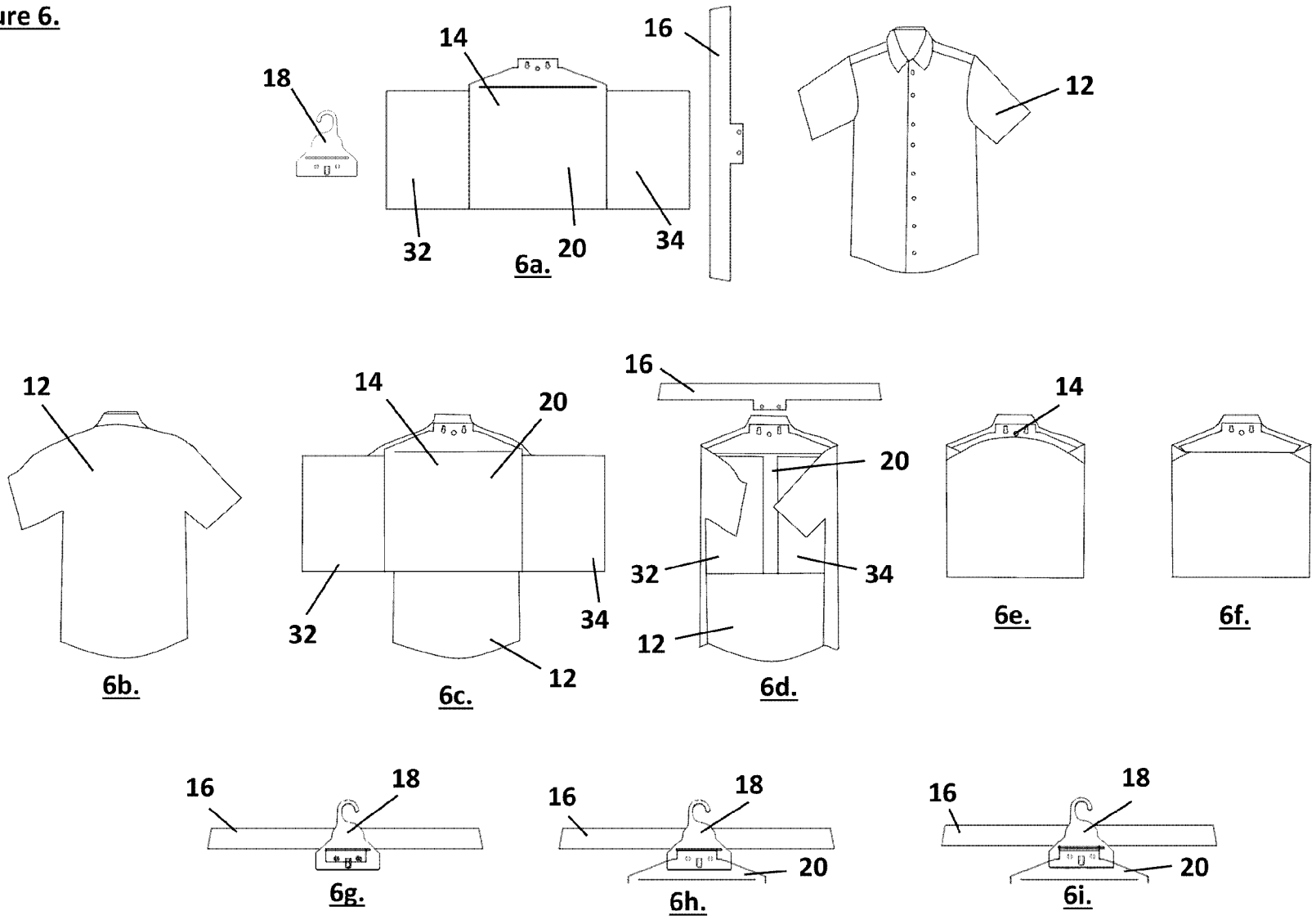
Figure 8:
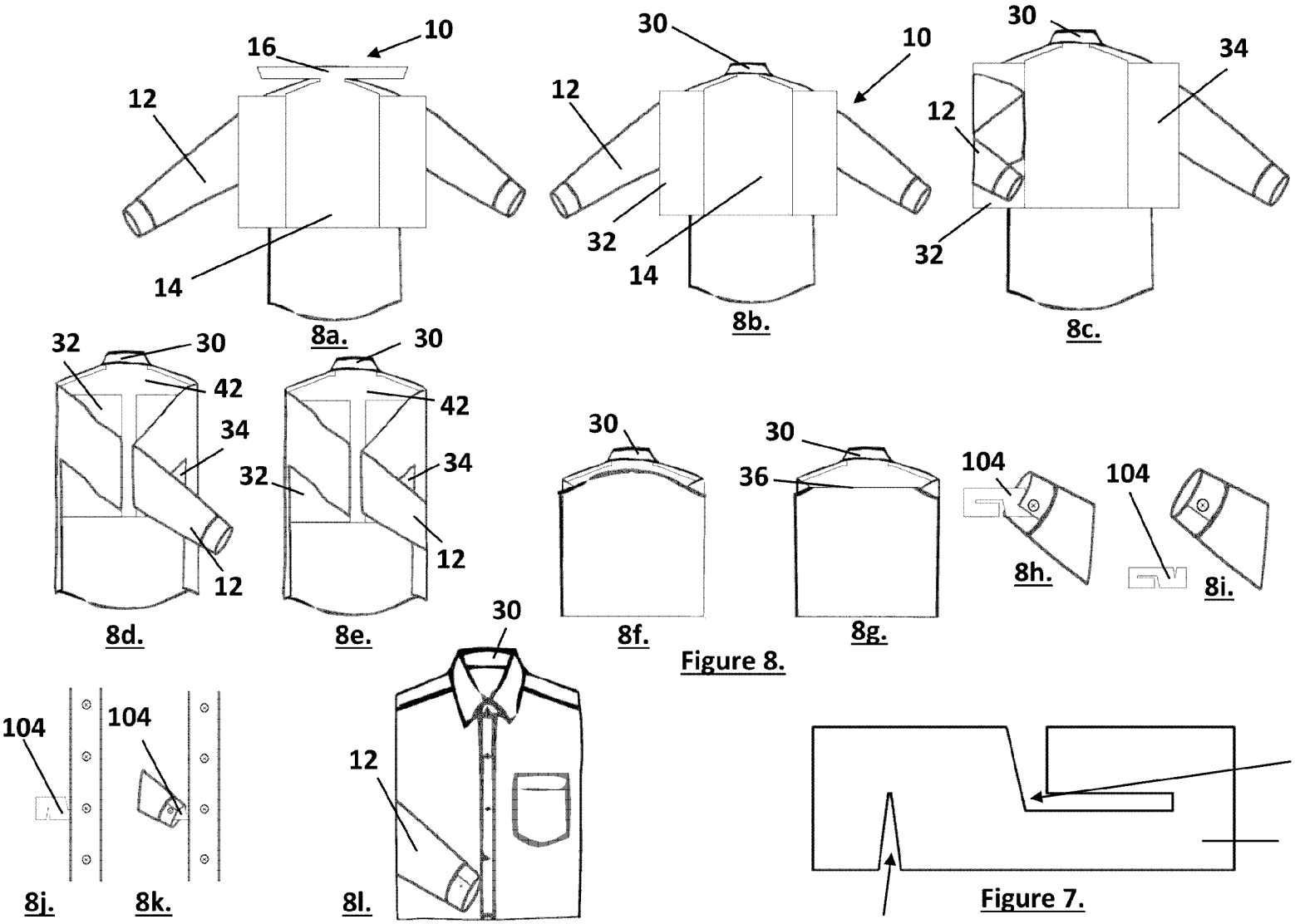
Figure 7:
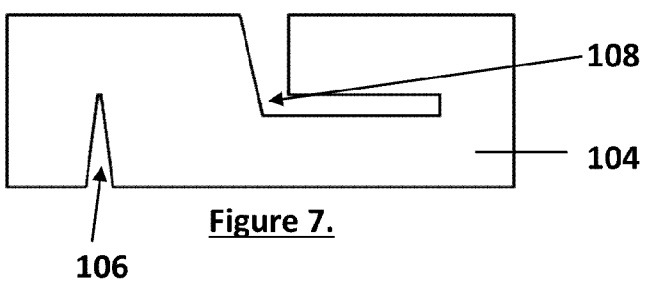

FIG. 6 (which includes sub-figure labels 5*a* to 5*i*) is a schematic representation showing the steps of loading a shirt onto the packaging material of the first embodiment of the present invention;

FIG. 7 is a plan view of a component used in conjunction with any of the embodiments of the present invention; and FIG. 8 (which includes sub-figure labels 8*a* to 8*l*) is a schematic representation showing the steps of loading a shirt onto the packaging material of the second embodiment of the present invention.

Figure 1:
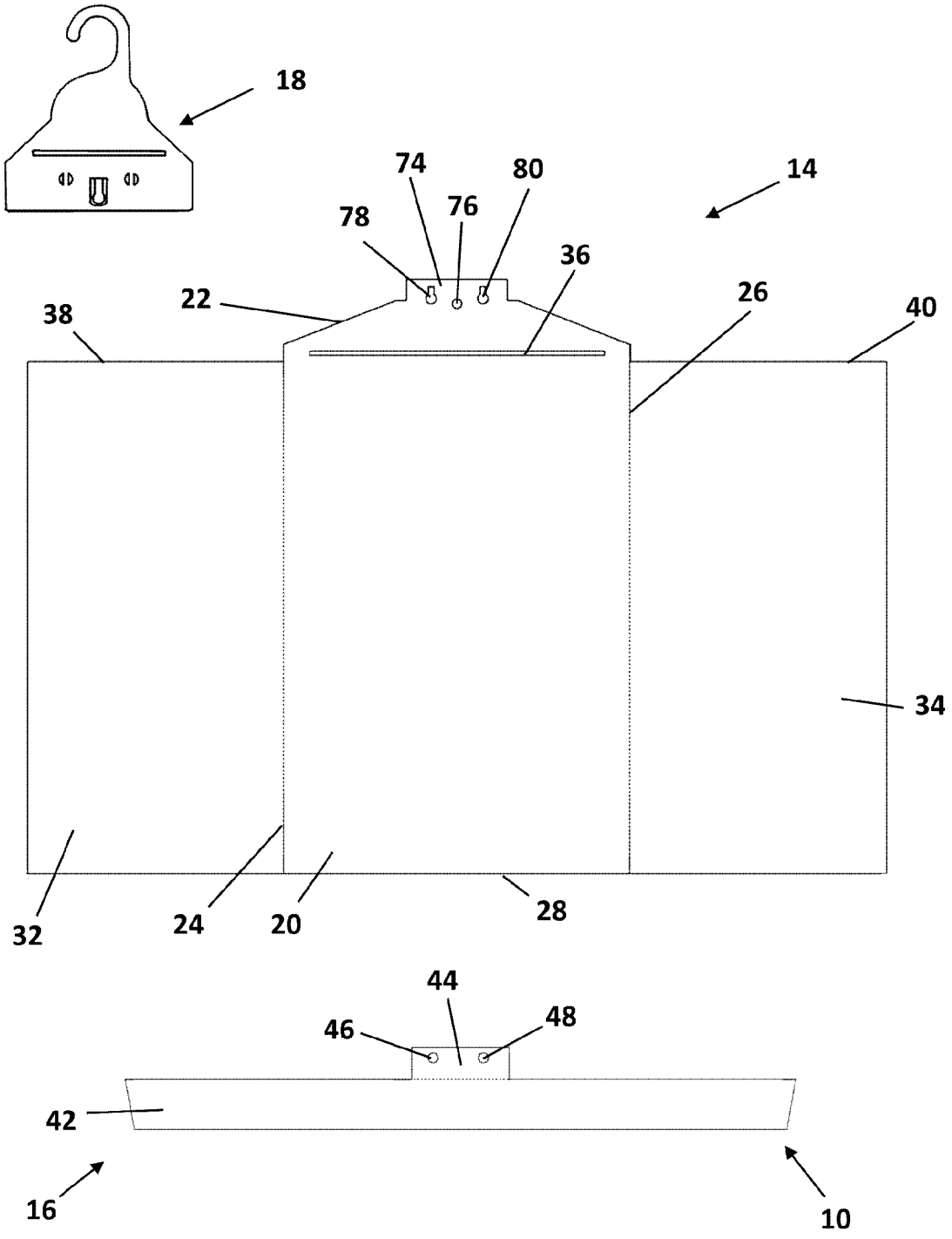
FIG. 1 is a plan view of a packaging material for a shirt of a first embodiment of the present invention.

A first embodiment of the present invention is shown in FIG. 1. A packaging material 10 for supporting and displaying a shirt 12 is formed in three parts, these being a main shirt body support 14, a collar support 16 and a hook 18. Looking first at the main shirt body support 14 this is formed from a sheet of cardboard material which includes a substantially rectangular body 20 which has four edges including a top edge 22, left edge 24, right edge 26 and a bottom edge 28. When the packaging material 10 is in use and supporting a shirt 12, the top edge 22 is located adjacent a collar 30 of the shirt 12.

Also forming part of the main shirt body support 14 are a pair of flaps 32 and 34. These flaps are attached to the body 20 with the left-hand flap 32 attached to the left edge 22 and the right-hand flap 34 attached to the right edge 24. The junction between the flaps 32 and 34 and the body 20, that is along the lines of the left and right edges 22 and 24, are scored to facilitate easy folding of the flaps relative to the body.

A slot 36 is formed in the body 20 of the main shirt body support 14 adjacent the top edge 22. This slot can be a simple single cut or can be formed as a wider slot with a thin piece of cardboard removed. The slot extends across the majority of the width of the body 20 and in the example shown in FIG. 1 this slot extends across approximately 90% of that width. However, the slot could be anything from around 40% to around 95% of that width and still function to fulfil the requirements of the present invention. Although in principle a slot of less than 40% of the width would work the bunching of the material of the shirt to get it through this short slot would create an aesthetically unacceptable presentation of a shirt loaded thereon. Most preferably the slot is between 70% and 90% of the width of the body. The slot 36 is approximately aligned with and slightly above the top edges 38 and 40 of the flaps 32 and 34.

In this embodiment of the invention the collar support 16 is formed as a separate component from the main shirt body support 14. Like the main shirt body support 14 the collar support 16 is formed from a cardboard material and is formed mainly as a strip of material 42 with a tab 44 extending from a long edge of the strip at a central location. The tab includes a pair of apertures 46 and 48 which, as is explained below, are used to connect the collar support 16 to the main body support 14 and the hook 18.

The packaging 10 of this embodiment of the present invention is designed to be hung from a rail (not shown) and therefore includes the hook 18. This component is formed separately from the main shirt body support 14 and collar support 16 and, in this embodiment, is formed from injection moulded plastic. The hook 18 is shown in more detail in FIG. 2 and includes a curved suspension portion 50 and a label area 52. Below that label area is a slot 54 and below that a locking mechanism 56. The purpose of the locking mechanism 56 is to ensure that the cardboard components, the main shirt body support 14 and collar support 16 are held together whilst allowing them to be separated in order to facilitate the easy reuse and recycling of the plastic component, that being the hook 18.

The locking mechanism 56 includes a pair of weight bearing projections 58 and a release tab 60. Each of the weight bearing projections 58 is formed as a pair of protrusions 62, with bases 64, the edges of which are part circular and together form an edge which describes the majority of a circle having a diameter similar to that to the apertures 46 and 48 in the tab 44 of the collar support 16. The release tab 60 includes a projection 66 which is mounted on a flexing arm 68 which is attached at an upper end 70 to the remainder of the hook just below the slot 54. The flexing arm 68 and projection 66 fit in an aperture 72 which allows the movement of these components. The hook 18 attaches to the collar support 16 via the apertures 46 and 48 and attaches to the main shirt body support 14 via a series of three apertures which are formed at the very top of the body 20 at least partially in a rectangular tab 74 which extends from the top edge 22. These apertures include a centrally located aperture 76 and a pair of inverted keyhole-shaped apertures 78 and 80. As explained below the keyhole apertures 78 and 80 cooperates with the weight bearing projections 58 and the central aperture 76 receives the projection 66 of the release tab 60.

Figure 2:
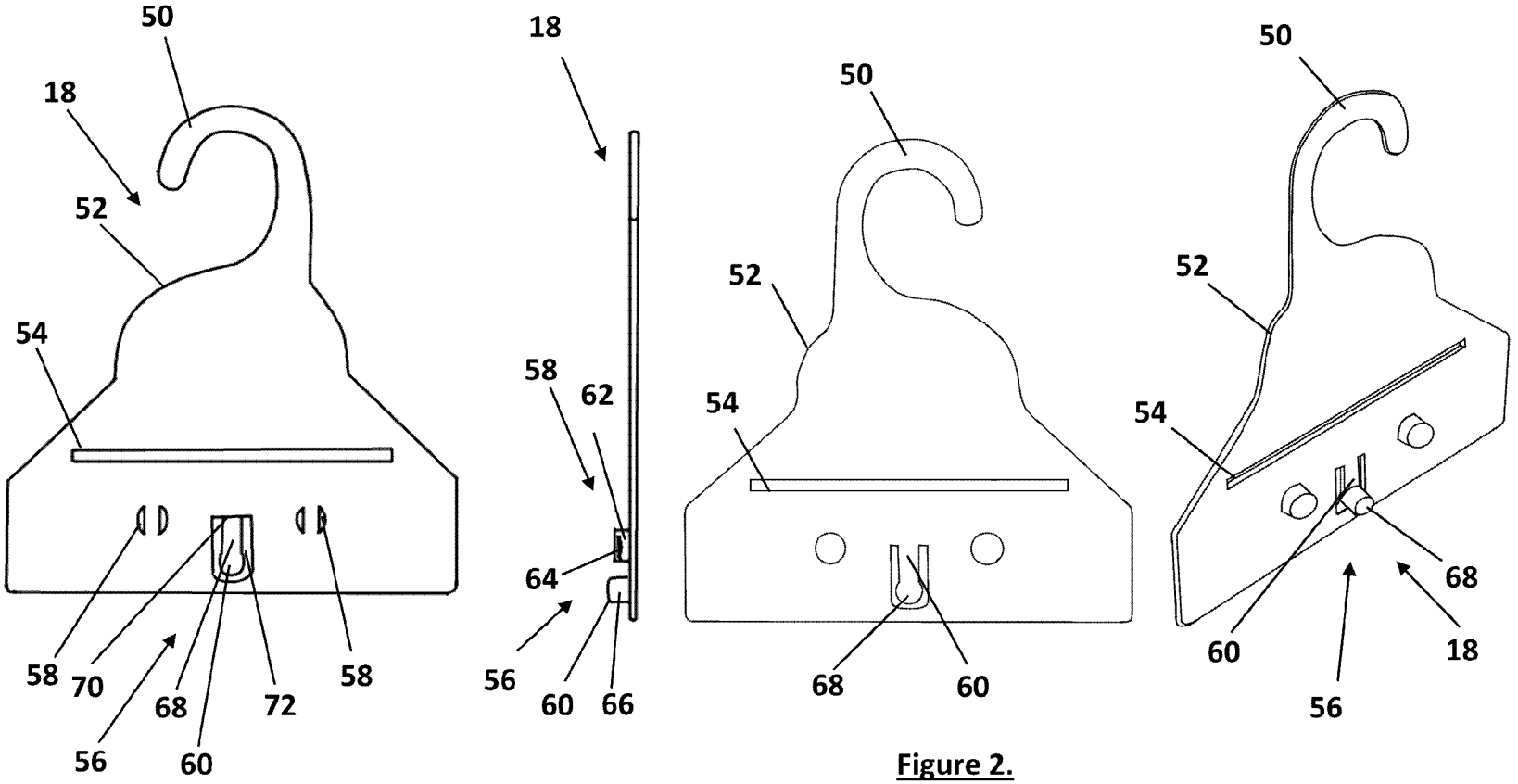
FIG. 2 is a front view, a side view and a perspective view of the hook used in the packaging material of FIG. 1.

The operation of the packaging material 10 of the first embodiment of the present invention, as shown in FIGS. 1 and 2, will now be described with additional reference to FIG. 6. The components of the first embodiment of the present invention are shown in FIG. 6*a*, together with the shirt 12. The shirt 12 is placed face down, as shown in FIG. 6*b*, and the main shirt body support 14 is placed on the back of the shirt 12 in an unfolded condition. That is with the body 20 and flaps 32 and 34 are arranged so that the fold lines that coincide with the left and right edges 24 and 26 remain unfolded (see 6*c*). As shown at FIG. 6*d*, the flaps 32 and 34 are folded inwards and the sleeves of the shirt, together with the sides of the shirt, are folded towards the centre so that the front of the shirt is taut across the body 20 of the main shirt body support 14. The amount of the fabric of the shirt which extends over the folded in flaps 32 and 34 depends on the size of the shirt which is being mounted to the packaging. The collar support 16 is also added to the shirt 12 by tucking it under the collar of the shirt as is known in the art. The tab 44 extends downwards from the collar but because the shirt is mounted on the main shirt body support the loop of the collar is coplanar with the plane of main shirt body support. The tab 44 therefore extends from the collar perpendicular to the plane of the main shirt body support 14.

The tail of the shirt is then folded up towards the collar with that fold being located at the bottom edge 28 of the body 20 (see 6*e*). The tail of the shirt 12 which extends above the position of the slot 36 is tucked into the slot with any of this excess material being tucked into the space between the front of the shirt and the face of the body 20, which the front of the shirt engages (see 6*f*). This should be tucked carefully so as to provide as flat surface as possible to present the front of the shirt, since this is the part which is on display.

When a shirt is on display the collar is not in an orientation that is the same as when it is worn by a person. The collar is arranged so that it extends downwards, in other words, the teardrop shape described by the upper edge of the collar is in a plane which is parallel to the plane of the body 20. As a result, when the collar support 16 is loaded onto the collar the tab 44 extends perpendicular to the plane of the body 20. In order to attach the hook, the slot 54 is introduced to the tab 44 from the back of the shirt so that the tab extends through the slot. The tab 44 is then folded through 90° towards the bottom edge 28 of the body 20 so that the apertures 46 and 48 extend over the weight bearing projections 58 (see 5*g*). The main shirt body support 14 is then introduced to the hook 18 with the weight bearing projections 58 engaging the keyhole apertures 78 and 80 through the circular portions (see 5*h*). The main shirt body support 14 can then be locked into place by moving the hook upwards so that the weight bearing projections 58 move into the narrower portions of the keyhole apertures 78 and 80 with the bases 64 of the protrusions 62 extending outwards over the edges of the narrower portions of these apertures, thereby preventing the rectangular tab 74, from moving away from the hook 18 in a direction that is perpendicular to the plane of the body 20 and the hook 18 (see 5*i*).

When the weight bearing projections 58 have moved into the narrower portions of the keyhole shaped apertures 78 and 80 the projection 66 of the release tab 60 is aligned with the central aperture 76 on the body 20. The projection 66 then prevents vertical movement of the hook 18 relative to the main shirt body support 14, thereby ensuring that the hook 18 remains locked to the remainder of the packaging material 10. The collar support 16 is sandwiched between the hook 18 and main shirt body support 14.

The hook 18 can be removed from the main shirt body support 14 and the collar support 16 by reversing the above engagement process. In particular, the projection 66 is pushed back into the apertures 72, thereby bending the flexing arm 68 and allowing the movement of the weight bearing projections 58 within the keyhole-shaped apertures 78 and 80. Once the weight bearing projections 58 are aligned with the larger circular portions of the keyhole shaped apertures 78 and 80 weight bearing projections can be released from the engagement with these apertures and the apertures 46 and 48 in the tab 44 of the collar support 16. As a result, the hook 18 can be easily disengaged from the two cardboard components at the point at which the sales transaction takes place thereby allowing the hook to be removed for reuse or recycling and allowing the customer purchasing the shirt to take only the cardboard components of the packaging material with them which can be readily recycled at home.

Further embodiments of the present invention will now be described with additional reference to FIGS. 3, 4 and 5. Parts which are in common with the first embodiment have been identified using the same reference numeral. Where the function of these features is the same as in the first embodiment details will not be repeated for the subsequent embodiments and can be inferred from the description above.

Figure 3:
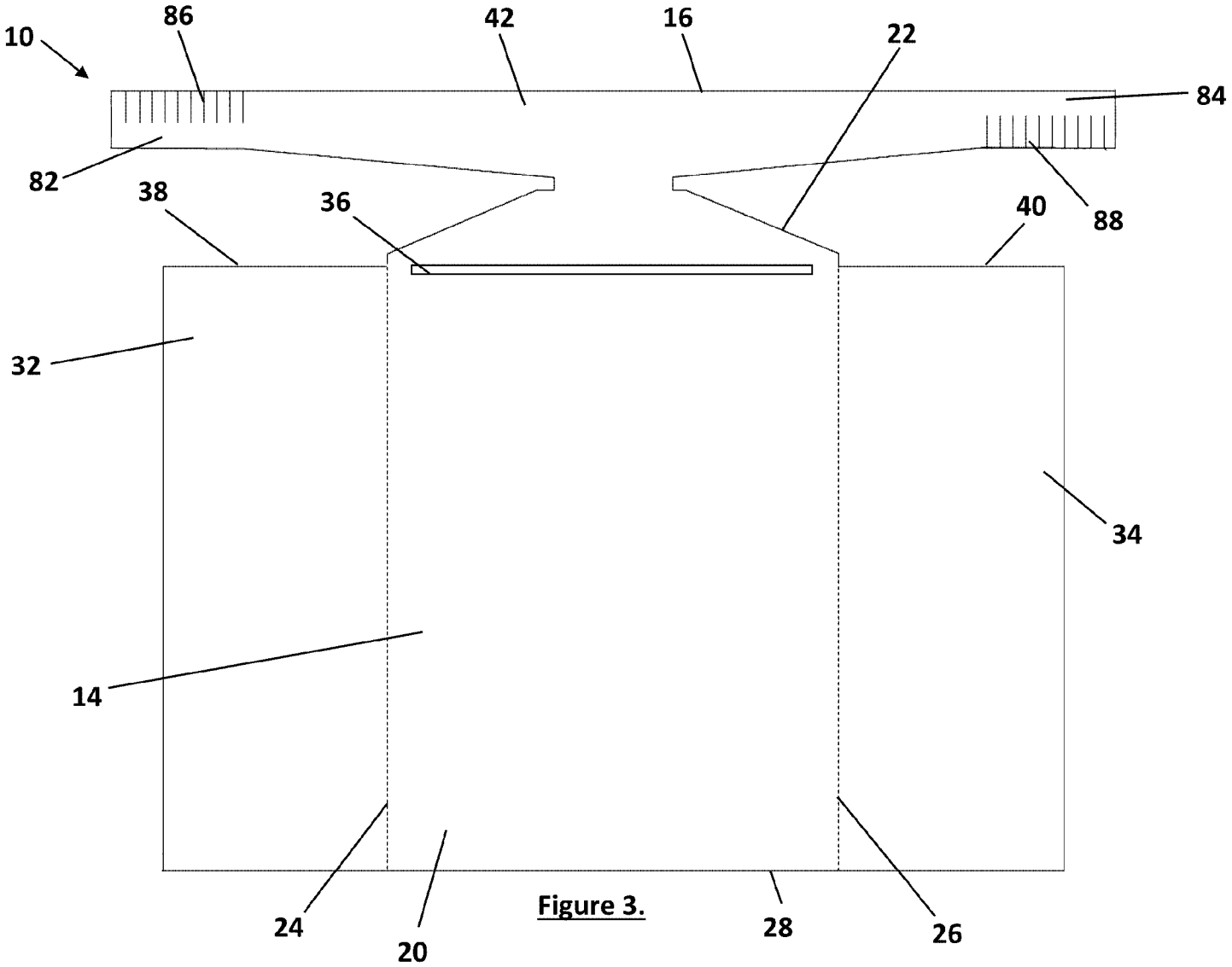
FIG. 3 is a plan view of a packaging material for a shirt of a second embodiment of the present invention.

Turning initially to FIG. 3, the packaging material 10 shown therein has the main shirt body support 14 formed as a single component with the collar support 16. The function of the flaps 32 and 34 and the slot 36 are in line with that previously described, but the package is not designed to be hung from a rail instead being displayed on a supporting surface such as a table. A collar support of this type sits between the two parts of the collar, wear a tie would be located when the shirt is in normal use. The collar support 16 forms a complete loop with the ends 82 and 84 linked together using slots 86 and 88 formed in opposing long edges of the strip 42. As a result, the linked slots of the collar support are visible at gap between the two ends of the collar and the centre of the neck of the shirt. These slots 86 and 88 are partially or entirely formed as perforations which are only broken when required for use. When the collar support is to be used the appropriate slots for the size of collar shirt are selected and the perforations broken or torn so as to produce the full slot. The opposing slots can then be engaged with each other so as to form the loop. The strength of the collar support is maintained because only the required slots are opened and the perforations in the unused slots maintain the structural integrity of the support when in use. The operation of this second embodiment of the present invention in the form of the packaging material 10 shown in FIG. 3 is to load the shirt onto the main shirt body support 14 is described above and once loaded to form the loop of the collar support 16 which is then folded over and tucked into the opening of the collar of the shirt.

Figure 4:
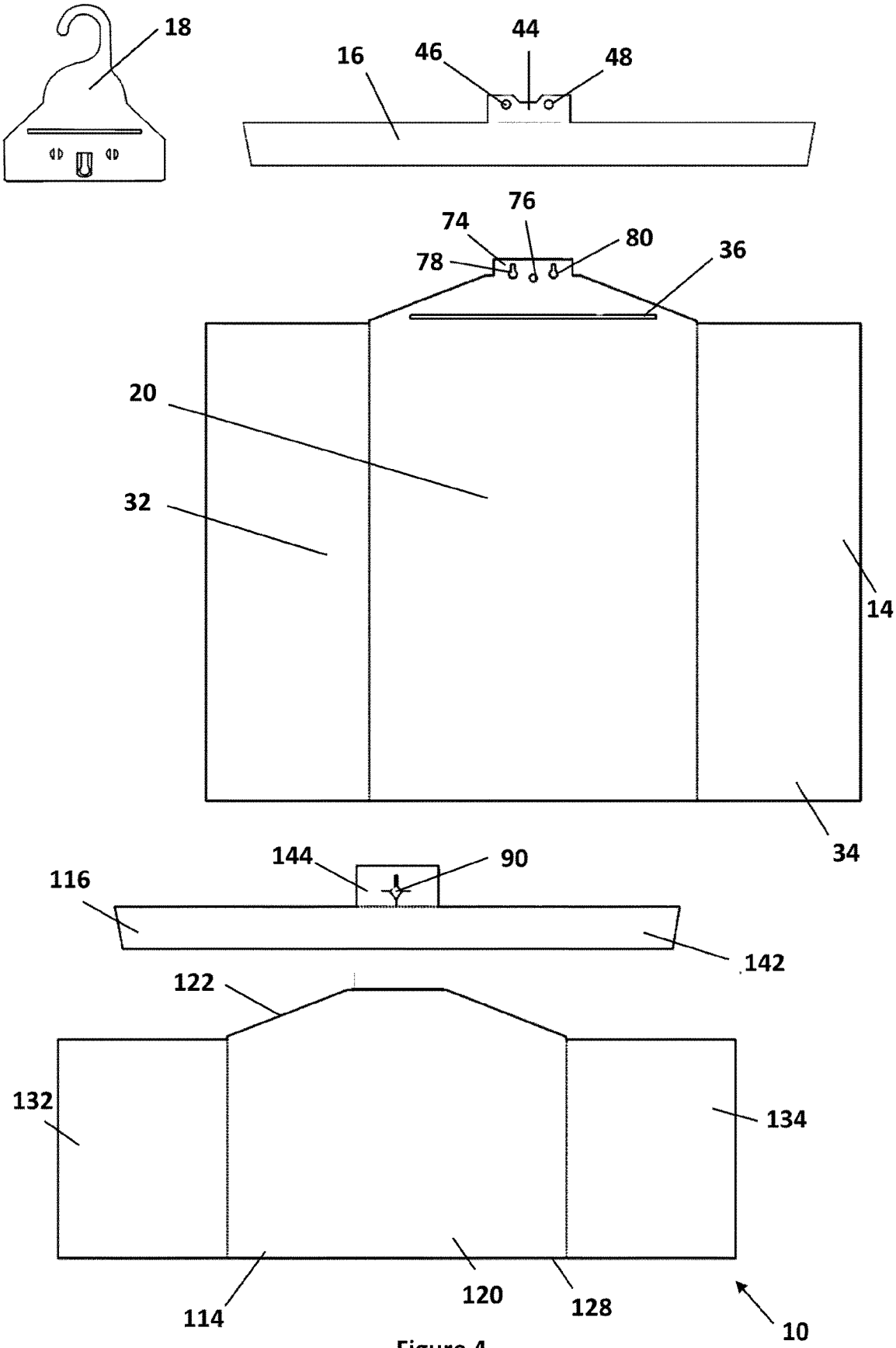
FIG. 4 is a plan view of a packaging material for a pair of shirts of third embodiment of the present invention.
Figure 5:
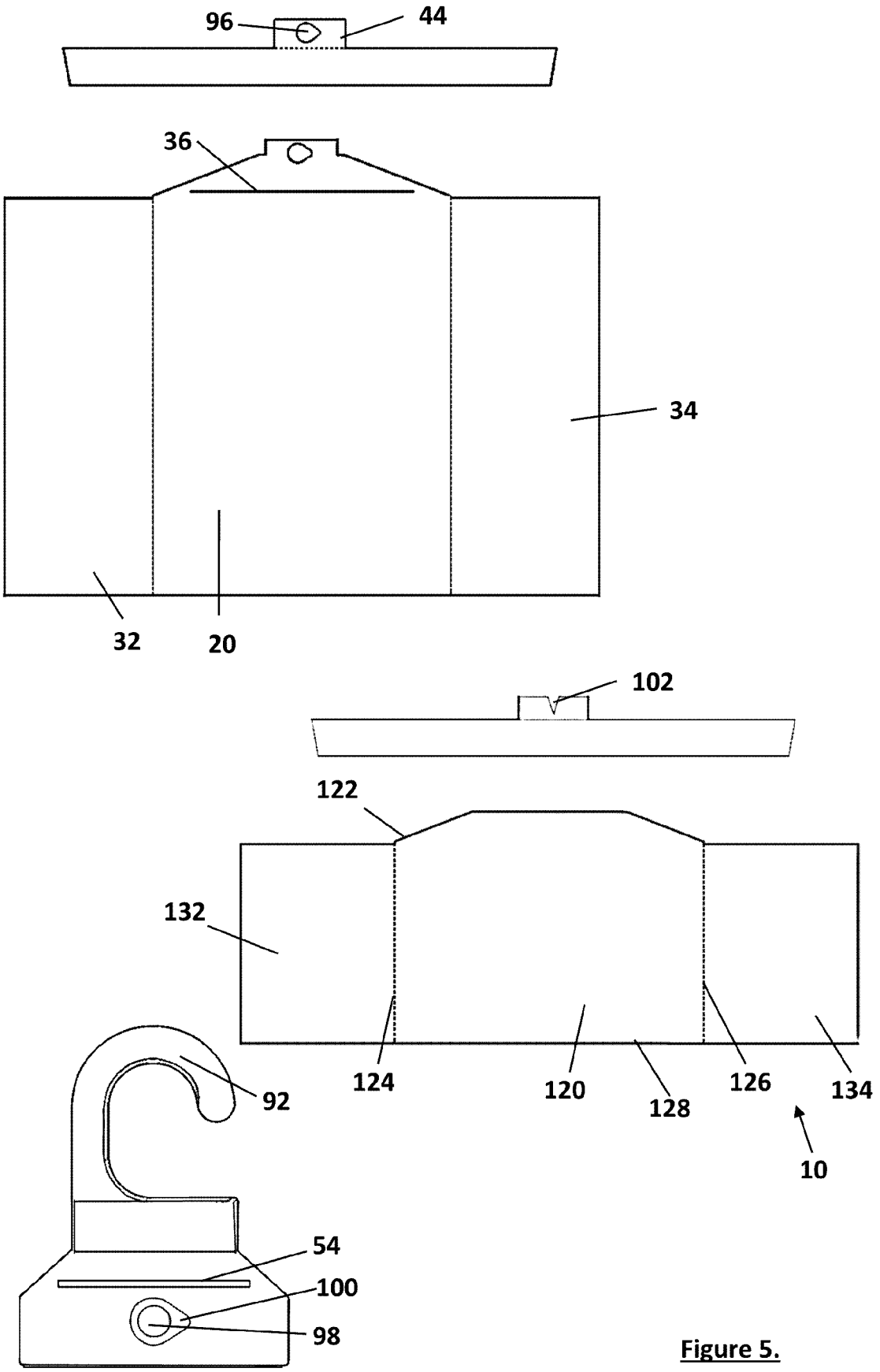
FIG. 5 is a plan view of a packaging material for a pair of shirts of a fourth embodiment of the present invention.

The third and fourth embodiments of the present invention, shown in FIGS. 4 and 5, are provided to display pairs of shirts in a two-pack or twin-pack arrangement for sale. Looking initially at FIG. 4, the packaging material 10 includes the main shirt body support 14, collar support 16 and hook 18 which are identical to those described in the first embodiment of the present invention and shown in FIGS. 1 and 2. In addition, a secondary shirt body support 90 and a secondary collar support 92 are also provided. The parts of these components which are in common with those of the main shirt body support 14 and collar support 16 have been given like reference numerals increased by 100. The secondary shirt body support 114 functions in essentially the same manner as the main shirt body support 14 except that the tab 74 and apertures 76, 78 and 80 are not present nor is the slot 36. The secondary collar support 142 has the tab 144, but this differs from the tab 44 in that the tab is larger and the apertures 46 and 48 have been replaced with a button receiving aperture 90. This aperture is shaped and sized to receive a button of the first shirt, which is on display and this helps to retain the second shirt in the correct position relative to the first shirt. In this embodiment, the aperture 90 is shaped with a central opening and four slots cut extending from an opening each at 90° to the adjacent slot, thereby forming a cross shape. One of the slots is cut wider than the others in order to accommodate the thickness of the thread which is used to attach the button to shirt while the other cuts allow the sections of card between them to flex out the way to facilitate the introduction of the button into the aperture 90.

The twin shirt packaging of this third embodiment of the present invention, as shown in FIG. 4 operates in the following manner. The collar support 16 is attached to the collar of the first shirt so as to trap the support 16 between the two halves of the collar and this is repeated for the secondary collar support 116 with the second shirt. The button receiving aperture 90 is then attached to one of the buttons of the first shirt before the first and second shirts are turned over so that the front of the shirts are face down. The main shirt body support 14 is then placed onto the back of the first shirt. The secondary shirt body support 114 is then engaged with the back of the second shirt and the sleeves and sides of the shirts are folded towards the centre whilst folding in the flaps 32, 34, 132 and 134. This creates a long tail to the pair are shirts and this tail of the shirts is tucked into the slot 36 on the main shirt body support 14. The twin pack of shirts is ready for display.

The fourth embodiment of the invention, as shown in FIG. 5, functions in substantially the same way as the third embodiment just described, except for two key features. Firstly, the hook portion operates on a different principle and works in conjunction with a pair of apertures 94 and 96 on the main shirt body support 14 collar support 16 respectively. These apertures are teardrop shaped and cooperate with a weight bearing member 98 which has an equivalent teardrop-shaped retainer 100 at an end, distal of the main body of the hook 92. When the shirt has been loaded onto the main shirt body support 14, the tab 44 of the collar support 16 is threaded through the slot 54 in the hook 18. The teardrop retainer 100 is placed through the aperture 96. The teardrop retainer 100 is then aligned with the aperture 94 in the tab 74 of the main shirt body support 14 and pushed through it. The hook 92 and collar support 16 are then rotated through 180° so that the retainer is prevented from passing back through the aperture 94. The collar support 16 is then engaged with the collar of the first shirt. The process of removing the hook 18 is to reverse the above listed process.

The other main difference with the previous embodiment is that the button receiving aperture 90 has been replaced by a button receiving notch 102. Although less stable than the aperture 90, this notch also assists in ensuring that the collar of the second shirt remains in the correct position, whilst the twin back of shirts is on display.

Referring now to FIGS. 7 and 8, the process of using the packaging material 10 of the second embodiment set out above and shown in FIG. 3 is disclosed in FIG. 8 in conjunction with a sleeve position retainer 104, shown in FIG. 7. This component is a short strip of cardboard with a pair of notches 106 and 108 cut therein. The notch 106 is a V-shaped and attaches to a button in the cuff of the sleeve of a long sleeve shirt. The notch 108 is an L-shaped slot which attaches to one of the fastening buttons of the front of the shirt.

Turning to FIG. 8, at 8*a*, the shirt is placed face down and the main shirt body support 14 and collar support 16 (together as a single component) are placed on the back of the shirt, as seen at 8*b*. The collar support strip 42 is tucked into the back of the collar of the shirt. The left-hand sleeve is folded back on itself so as to cover the flap 32 while the right-hand sleeve is left extended (see 8*c*). The flaps 32 and 34 are folded inwards as are the sleeves and sides of the shirt, as seen at 8*d*. The right sleeve is folded back on itself and then folded round to the front of the shirt (see 8*e*) so as to be on display. When these positions have been completed the tail of the shirt is folded up, as seen at 8*f* and the tail tucked into the slot 36, as seen at 8*g*. At 8*h* and 8*i*, the sleeve position retainer 104 is engaged with the thread that retains the button on the cuff of the sleeve specifically with the V-notch 106. Then the long notch 108 is engaged with the required front shirt button, as seen at 8*j* and 8*k*, to create the final display of the shirt (as shown at 8*l*).

It will be appreciated by persons skilled in the art that the above embodiments have been described by way of example only and not in any limitative sense, and that various alterations and modifications are possible without departure from the scope of the protection which is defined by the appended claims. For example, the features of the packaging material described above are interchangeable with each other. That is features such as the slot 36, the flaps 32 and 34, the separately formed collar support 16 and hook 18 and the perforated slots 86 and 88 can be used alone or in conjunction with each other in any suitable combination above those specifically set out above. The above embodiments have been described for use with collared shirts. However, the same or very similar apparatus can be used to support and display collarless shirts (known as granddad shirts) as well as other tops including, but not limited to, t-shirts, blouses and thin jumpers.

The invention claimed is:

1. A packaging material for a shirt, the packaging material comprising:

a main shirt body support formed from a sheet of cardboard and comprising a body having a front surface, a rear surface, a top edge and a bottom edge, wherein said body has a slot located adjacent to said top edge and at least one locking feature located between the slot and the top edge, wherein the shirt is configured to be mounted to the main shirt body support such that a collar of the shirt is adjacent to the top edge of the body, a main body of the shirt is adjacent to the front surface of the body, and a tail of the shirt that extends beyond the bottom edge of the body is folded over the bottom edge of the body so that a lowermost portion of the tail can be passed through the slot;

a collar support comprising a strip of cardboard material having an elongated top edge and a tab protruding from the elongated top edge, the tab comprising at least one aperture, wherein, in use, opposing ends of said strip are configured to be curved back towards one other to support the collar of the shirt, wherein said collar support is formed separately from said body; and a hook comprising a substantially planar hook body having a bottom edge, a hook slot formed through the substantially planar hook body, and at least one retaining projection extending from said hook body and located between a bottom edge of the hook slot and the bottom edge of the planar hook body; and wherein said main shirt body support, said collar support, and said hook are configured to be coupled together by inserting the tab of said collar support through said slot in said hook to align the at least one aperture of said collar support with said at least one locking feature of said main shirt body support and inserting said at least one retaining projection of said hook through said at least one locking feature of said main shirt body support and said at least one aperture of said collar support.

2. The packaging material according to claim 1, further comprising:

the body of the main shirt body support comprising a first side edge and a second side edge extending between the top and bottom edges;

the main shirt body support comprising:

a first flap connected to said first side edge of said body at a first fold line, said first flap having a first top edge portion; and a second flap connected to said second side edge of said body at a second fold line, said second flap having a second top edge portion; and wherein the first and second flaps are configured to be folded about the first and second fold lines so that the first and second flaps overlie at least a portion of the rear surface of the body of the main shirt body support with the first and second top edge portions of the first and second flaps located between the slot and the bottom edge of the body of the main shirt body support.

3. The packaging material according to claim 1, wherein said collar support forms a loop and said ends are linked to one another by engaging slots formed in opposing long edges of said collar support, said slots being at least partially perforated.

4. The packaging material according to claim 1 further comprising:

the hook comprising a locking projection mounted on a flexible arm and adapted to engage a further locking aperture of said body of said main shirt body support such that when said locking projection is located in said further locking aperture movement of said body relative to the hook in a plane of said body is prevented.

5. The packaging material according to claim 1, wherein said body has a first side edge and a second side edge extending between the top and bottom edges, and wherein the slot of said body is elongated and extends linearly between the first and second side edges across a majority of a width of said body.

6. A packaging material for a shirt, the packaging material comprising:

a sheet of cardboard having a substantially rectangular body with at least four edges including a top edge which, when the packaging material is in use, is located adjacent a collar of the shirt mounted to the packaging material and left and right edges connected to, and located to the left and right of, the top edge, wherein said sheet further comprises a locking aperture and first and second flaps connected to said left and right edges of said body such that folding of said first and second flaps at least partially covers said body;

a collar support formed separately from said body, said collar support comprising a strip of cardboard material, a tab, and a retaining aperture, wherein, in use, opposing ends of said strip can be curved back towards each other to support the collar of the shirt; and a hook for suspending the packaging material and shirt from a rail and for joining said body and collar support, wherein said hook comprises a substantially planar hook body having a hook slot formed therein and a retaining projection extending from said hook body; and wherein said tab of said collar support is configured to be inserted through said hook slot, and wherein said retaining projection of said hook is configured to be inserted through said retaining aperture of said collar support and through said locking aperture of said body of said sheet of cardboard to couple said collar support and said hook to said body.

7. The packaging material according to claim 6 further comprising:

said hook comprising a locking projection mounted on a flexible arm and adapted to engage a further locking aperture of said body of said sheet such that when said locking projection is located in said further locking aperture movement of said body relative to the hook in the plane of said body is prevented.

8. A packaging material for a shirt, the packaging material comprising:

a sheet of cardboard having a substantially rectangular body having a front surface, a rear surface, and at least four edges including a bottom edge and a top edge which, when the packaging material is in use, is located adjacent a collar of the shirt mounted to the packaging material and left and right edges connected to, and located to the left and right of, the top edge, said top edge extending from said left edge to said right edge, wherein said body has a slot extending therethrough from the front surface to the rear surface, the slot being linear and elongated between the left and right edges, said slot located adjacent to said top edge and extending across a majority of a width of said body adjacent said top edge, and wherein said sheet further comprises first and second flaps connected to said left and right edges of said body such that folding of said first and second flaps at least partially covers said body, each of said first and second flaps having a top flap edge that is located between the slot of the body and the bottom edge of the body when the first and second flaps are folded so that the first and second flaps do not cover any portion of the slot when the first and second flaps are folded.

9. The packaging material according to claim 8 wherein said slot is oriented perpendicular to said left and right edges of said body.

10. The packaging material according to claim 8 wherein said slot is oriented parallel to the bottom edge of said body.

11. The packaging material according to claim 8 wherein said width of said body is measured from said left edge of said body to said right edge of said body.

12. The packaging material according to claim 8 wherein the slot extends linearly between the left and right edges of said body such that a distance between said slot and said bottom edge of said body is constant.

13. The packaging material according to claim 8 wherein the top flap edge of the first and second flaps lie in a plane that intersects the body of the sheet of cardboard at a location between the slot and the bottom edge.

14. The packaging material according to claim 13 further comprising:

the top flap edge of the first and second flaps being parallel to the bottom edge of the body; and the top edge of the body being oblique to the top flap edge of the first and second flaps.

15. The packaging material according to claim 14 wherein an exposed portion of the left edge of the body extends from the top flap edge of the first flap to the top edge of the body and wherein an exposed portion of the right edge of the body extends from the top flap edge of the second flap to the top edge of the body.

16. The packaging material according to claim 15 wherein a bottom edge of the slot extends along an axis that intersects the exposed portions of the left and right edges of the body, and wherein the axis does not intersect either of the first and second flaps.

* * * * *